United States Patent [19]

Persson

[11] 4,076,467

[45] Feb. 28, 1978

[54] SPECIALLY REINFORCED FLEXIBLE TUBE PUMPING CHAMBER

[76] Inventor: Jan Edvard Persson, Henriksdalsringen 17[5], 131 00 Nacka, Sweden

[21] Appl. No.: 653,392

[22] Filed: Jan. 29, 1976

[30] Foreign Application Priority Data

Jan. 31, 1975 Sweden ..... 7501054
Apr. 11, 1975 Sweden ..... 7504177

[51] Int. Cl.[2] ..... F04B 43/08; F04B 45/06; F04B 11/00

[52] U.S. Cl. ..... 417/478; 417/540; 92/94

[58] Field of Search ..... 417/478, 480, 244, 257, 417/265, 472, 540; 92/94

[56] References Cited

U.S. PATENT DOCUMENTS

| | | | |
|---|---|---|---|
| 1,546,973 | 7/1925 | Ellis | 417/478 |
| 1,722,377 | 7/1929 | Kaplan | 417/478 |
| 2,553,542 | 5/1951 | Bodine | 417/244 |
| 2,810,351 | 10/1957 | Bower | 417/478 |
| 3,253,549 | 5/1966 | Vincent et al. | 417/394 |
| 3,317,141 | 5/1967 | Mann | 417/478 |
| 3,409,184 | 11/1968 | Stengle | 417/472 |
| 3,481,254 | 12/1969 | Wetherbee | 92/94 |
| 3,839,983 | 10/1974 | McAusland | 417/478 |

*Primary Examiner*—Carlton R. Croyle
*Assistant Examiner*—Thomas I. Ross

[57] ABSTRACT

A pump comprises a tubular resilient pump element alternately extended and relaxed for longitudinal deformation and reinforced by means of filaments arranged in helices, preferably with different helices of opposite hands present, whose pitch angle is other than arccot $\sqrt{2}$ so longitudinal deformation will result in volumetric changes. Inlet and outlet valves ensure unidirectional flow through the pump element.

To smooth out flow a similarly constructed accumulator element, whose reinforcement pitch angle is chosen with a value such that the pump and accumulator pitch angles are on opposite sides of arccot $\sqrt{2}$, is arranged to undergo simultaneous and similarly directed longitudinal deformation and to have a volumetric change of opposite sign, and preferably half the value, with regard to that of the pump element whereby during the inlet stroke of the pump element the accumulator element, which communicates with the discharge flow path from the pump element, will advance a proportion, preferably half, of the previous discharge stroke of the pump element.

15 Claims, 7 Drawing Figures

SPECIALLY REINFORCED FLEXIBLE TUBE PUMPING CHAMBER

The present invention relates to a pump, preferably intended for pumping water, comprising a variable volume operating chamber arranged to cooperate by means of valves with a discharge pipe for the medium to be pumped.

The simplest pumps known hitherto are the piston and cylinder type and are nevertheless relatively complicated in construction.

Such conventional piston pumps require careful internal machining of the cylinder. Furthermore, the necessary piston rod packings cause considerable friction as well as being subjected to debilitating wear and requiring regular servicing. Furthermore, for the actual transmission of reciprocating movement to a piston rod in such known pumps — both tensile and compressive loads must be transmitted so a compression-resistant strut or rod is often used and disposed coaxially inside the discharge pipe. This is both expensive and bulky in that the discharge pipe must have considerable dimensions. Attention must also be paid to the large diameter connecting sleeves required to couple together separately formed lengths of the piston rod.

It is an object of the present invention to eliminate the drawbacks of the known piston pumps and to effect a reliable pump which is simple from the constructional point of view.

According to the present invention I provide a pump comprising a variable volume operating chamber arranged to cooperate by means of valves with a discharge pipe for the medium to be pumped, the operating chamber comprising at least one elastomeric tubular pump element arranged to be strained for alternate extension and contraction axially in order to effect pumping.

In a preferred embodiment of the invention the pump comprises a pump housing with openings for inlet and discharge of a pumped medium; and an operating link cooperating with said pump element and vertically movable in the pump housing, said valves comprising non-return valves arranged in the inlet and outlet to the pump element, one end of said pump element being connected to the operating link and the other end being secured in the pump housing so that when a tensile force is applied to the operating link the pump element is extended and caused to decrease in volume resulting in ejection of pumped medium present in the pump element out through the outlet non-return valve, and that upon the return movement of the operating link an increase in volume occurs resulting in flow of the pumped medium into the pump element through the inlet non-return valve.

Preferably said operating link is hollow and serves as the pump discharge conduit communicating with the outlet non-return valve from the pump element.

Advantageously the tubular pump element may consist of an elastomeric basic compound with reinforcement embedded therein, the reinforcement preferably consisting of filaments i.e., or wire wound helically in both directions i.e., opposite hand direction.

The pump effect may conveniently be achieved by these helically wound threads producing a diametral contraction of the pump element as said element is extended. At a pitch angle of arccot $\sqrt{2}$ ($\sim 35.2°$), the decrease in volume resulting from the diametral contraction is nullified by the increase in volume caused by the extension.

With greater pitch angles the volumetric change from diametral contraction exceeds that from the axial extension and thus the pump element acquires decreased volume upon extension. With smaller pitch angles the change in volume caused by the extension prevails over that from the diametral contraction and the volume increases upon extension.

In order to achieve a uniform flow of liquid, a preferred embodiment of the invention employs an accumulator element opening downstream from the pump element outlet and before the discharge conduit, the accumulator element being in the form of a tube of an elastomeric material with reinforcing threads placed helically in both directions with a pitch angle deviating from arccot $\sqrt{2}$ ($\sim 35.2°$) such that the pitches of the reinforcement in the pump element and in the accumulator element are on opposite sides of arccot $\sqrt{2}$ so that the alteration in volume of the accumulator element upon simultaneous extension acquires the opposite sign to the simultaneous alteration in volume of the pump element. The accumulator element may either be connected in series with the pump element so that all the pumped flow passes through the accumulator element or the accumulator element may be arranged inside the pump element and connected to the upper and lower ends thereof while having one end closed and the other in open communication with a space downstream of the outlet valve of the pump element.

In order that the invention may more readily be understood the following description is given merely by way of example with reference to the accompanying drawings, in which.

Figure 1:
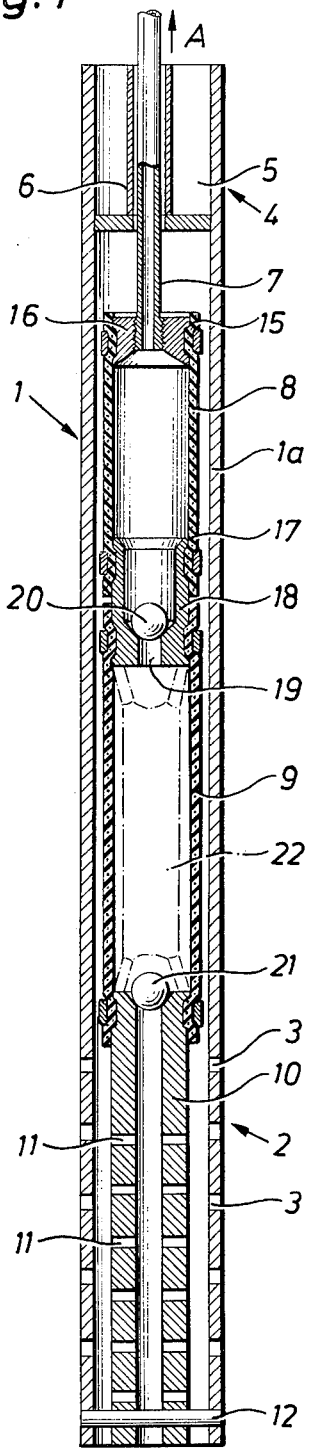
FIG. 1 shows a longitudinal section through a first embodiment of a pump according to the invention, depicted in normal position.

The pump shown in FIGS. 1 to 4 comprises a pump housing 1 with an outer, protective pipe 1*a*. The lower part 2 of the pipe 1*a* is provided with a number of openings 3, preferably in the form of slots, to allow radially inward flow of the pumped medium, and the upper part 4 of the pipe 1*a* is designed as an annular chamber 5, open at the top, with a central axial guide base 6 for a pump or operating link 7. The link 7 also serves as discharge pipe for the medium being pumped up.

The extension of the rod 7 projecting into the outer pipe 1*a* is connected to the flexible pump element 9 via a flexible accumulator element 8, further described below, and to a suction tube 10 located in the lower end 2 of the outer pipe 1*a*. The suction tube 10 is provided with a number of, preferably slotlike, openings 11 and is also fixed to the outer pipe 1*a* by means of a member 12 suitable for the purpose.

In the embodiment shown the flexible pump element 9 itself consists of an elastic tube comprising a rubber elastic material with reinforcing filaments 13. The reinforcement material itself should have considerable flexural stiffness as well as having only slight tensile resilience and the reinforcement filaments should be wound helically in both directions in such a manner that good elasticity is obtained in the resulting composite structure. To this end the filaments are, in the preferred form, formed of metal wire.

Figure 3:
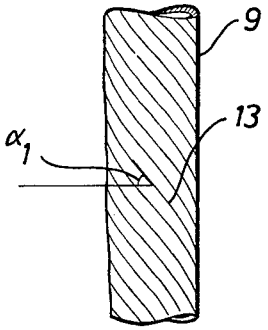
FIGS. 3 and 4 show in detail the construction of the walls of the pump element and accumulator element, respectively.
Figure 4:
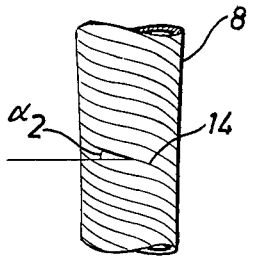
Figure 5:
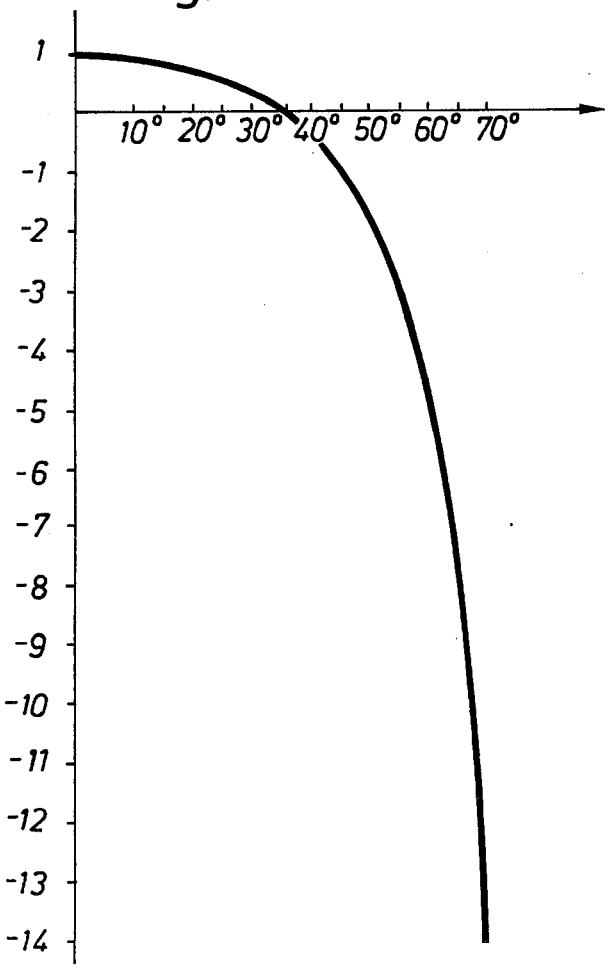
FIG. 5 is a graph showing the relationship between the pitch angle of the reinforcements and the alteration in volume of the pump or accumulator element shown in FIGS. 1 to 4 upon extension.

As can be seen more clearly from FIGS. 3, 4 and 5, the pitch angle $\alpha_1$ of the reinforcing filaments 13 is of decisive importance for the function of the resilient pump element. The choice of a suitable pitch angle is an optimization dependent upon the conditions for which the pump is intended, the properties desired and other dimensioning.

A pitch angle larger than $\alpha_o$ (where $\alpha_o = \text{arccot} \sqrt{2} = 35.2°$) gives a greater pump flow but also requires greater tractive force. Increasing liquid heads in any case require greater tractive force, and thus on a suction pump with a high head of liquid being pumped the tractive force is compensated for by using a lower pitch angle, naturally at the cost of pump flow rate.

As is clear from FIG. 5, the following alterations in volume are obtained for 1% extension with various pitch angles:

| $\alpha_1$ : | % |
|---|---|
| 0° : | 1% increase |
| 5° : | 0.985% |
| 10° : | 0.940% |
| 15° : | 0.855% |
| 20° : | 0.735% |
| 25° : | 0.568% |
| 30° : | 0.333% |
| $\alpha_o$ : | 0% (unchanged) |
| 40° : | −0.412% decrease |
| 45° : | −1.0% |
| 50° : | −1.835% |
| 55° : | −3.09% |
| 60° : | −5.0% |
| 65° : | −9.2% |
| 70° : | −14.1% |

Figure 2:
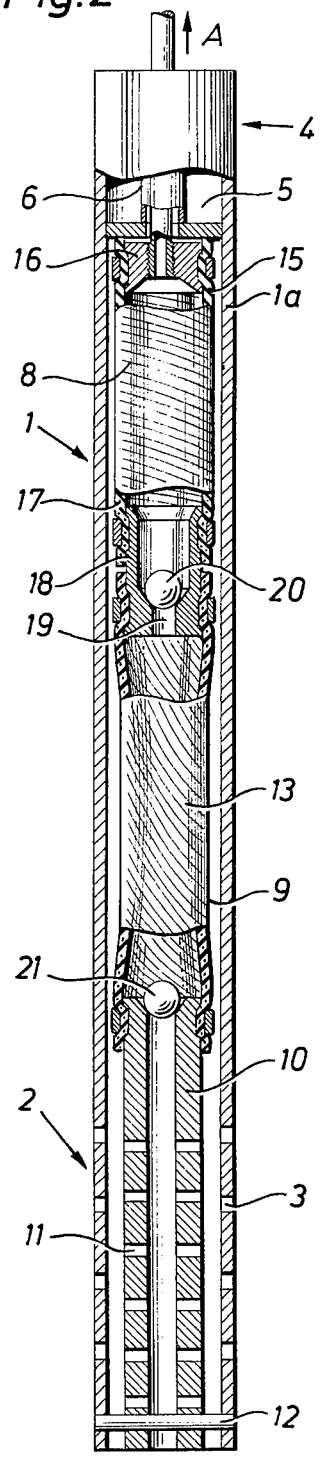
FIG. 2 shows the pump according to FIG. 1 in an operating position.

In the embodiment shown in FIGS. 1 and 2 the accumulator element 8 arranged between the pump element 9 and the reciprocating tubular pump rod or operating link 7 consists of an elastomeric tube similar to the pump element 9 but with the reinforcement 14 placed at a shallow pitch angle, i.e. with a pitch angle less than 35.2°. The upper part 15 of the accumulator element 8 is connected to the operating link 7 with the help of a connection piece 16. At its lower end 17 the accumulator element 8 is secured to a connection piece 18 which also projects into and is joined to the upper end of the pump element 9. The connection piece 18 is provided with a central bore 19 arranged to cooperate with a first ball valve 20. Furthermore, the upper end of the suction pipe 10 which protrudes into and is connected to the lower end of the pump element 9 is arranged to cooperate with a second ball valve 21.

In the embodiment shown in FIG. 1 a filler body 22 is also shown inside the pump element 9. The filler body 22, which may suitably consist of an incompressible elastomeric material, is secured to the connection piece 18 and the suction tube 10 at the ends of the pump element 9.

The pump shown in the drawing functions as follows:

For use in a well pumping application the pump 1 is lowered into a well which need have a diameter only slightly greater than the protective pipe 1*a*. When the end of the tubular operating link 7 protruding from the pump 1 is subjected to axial movement in the direction of the arrow A the pump element 9, due to the reinforcement, is subjected to a diametral contraction (compare FIG. 2), which has a greater influence on the volume of the element than does the axial extension of the element, thus producing a decrease in volume in the element. The volume displaced flows past the ball valve 20. Upon the return movement of the operating link 7, the volume of the pump element increases again, whereupon additional medium to be pumped is drawn in through the inlet ball valve 21. The pump element 9 thus has an intermittent function, alternately expelling and drawing in the medium being pumped.

The arrangement of the accumulator element 8 between the pump element 9 and the tubular operating link 7 provides a simple manner of smoothing out the otherwise liquid flow in the discharge pipe during pumping. This is achieved by means of the special reinforcement of the accumulator element 8 where the pitch angle of the reinforcing threads is low and results in an extension of the accumulator element 8 upon axial displacement of the operating link 7 in the direction of the arrow A giving an increase in volume in the accumulator element 8. The length of the accumulator element 8 is preferably so chosen in relation to the pump element 9 that when the operating link 7 is pulled in the direction of the arrow A approximately half the volume of medium supplied by the pump element 9 will be absorbed by the volumetric increase of the accumulator element 8 while the other half of the volume supplied from pump element 9 continues up through the conduit within link 7. The stored half of the quantity of medium supplied from pump element 9 and absorbed in the accumulator element 8 is then pumped up during the return descent of the operating link.

With such an accumulator element 8 a flow smoothing effect is also obtained in the supply from the well since the outer volume of both elements 8 and 9 alters in the same manner. This reduces the risk of collapse and clogging in unstable formations.

A continuous flow of liquid may of course be effected by means of a reversed construction, i.e. by giving the reinforcement of the pump element 9 a low pitch angle (<35.2°) and that of the accumulator element instead a pitch angle greater than 35.2°. In this case the pump element 9 will instead obtain its suction period during elongation, i.e. while the operating link is being raised, and, in this case the accumulator elements will at the same time be emptied.

The functioning described above is suitable if the pump can be immersed below the level of the liquid concerned and the liquid can freely fill up the pump to the external level.

However, if for some reason the suction pipe 10 must be made longer and the pump according to the invention be placed above the surface of the liquid so that it must effect a self-priming effect, this may preferably be achieved by using a filler body such as 22 in the pump element 9. Since the filler body is connected at both ends to the valve housings, the body 22 is extended together with the pump element and acquires a diametral contraction. This is, however, no greater than would allow its original volume to be retained. Its outer shape should be such that in extended position it entirely fills the pump element 9 which then assumes its smallest volume so that all internal space, apart from necessary flow channels and valve spaces, is eliminated.

The annular chamber 5 at the upper end of the protective pipe 1*a* is intended to catch any debris falling from the wall of the well and prevent such debris from becoming wedged in the pump. The openings in the lower part of the protective pipe 1*a* to let in water should be designed to limit the ingress of larger particles into the suction pipe 10 of the pump. The slots in the suction pipe 10 should in turn be designed to effect further filtering. Furthermore, the protective pipe 1*a* together with the suction pipe 10 should have a weight when immersed in water which is greater than the tractive force on the operating link 7 required for the pumping extension of the elements 8 and 9, if no separate locking means are to be employed for holding the pump down the well.

Figure 6:
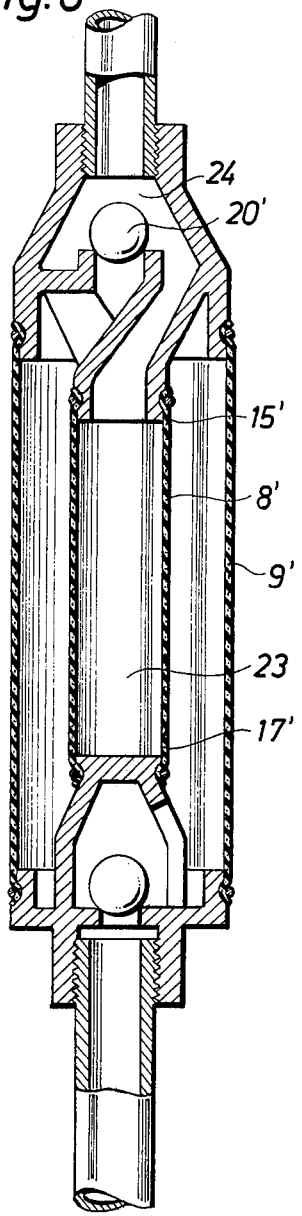
FIG. 6 is a longitudinal section through another embodiment of the pump.

In the alternative embodiment shown in FIG. 6 the accumulator element 8' and the pump element 9' are constructed in the same way as in the first embodiment described above. As is also clear from FIG. 6 the accumulator element 8' is connected by its lower, closed end 17' to the lower end of the pump element 9' and by its upper end 15' to the upper end of the pump element 9' leaving the internal volume 23 of the accumulator element 8' in open communication with a space 24 located above, i.e. downstream of the outlet valve 20' of the pump element 9'.

The reinforcing filaments and their pitch angles used in the pump element 9' and the accumulator element 8' are chosen in the same manner as those stated for FIGS. 1 and 2. In the present embodiment, however, the difference in the diameters of the accumulator element 8' and pumping element 9' must be taken into account when adjusting the elastic volume-altering properties of these elements to ensure that during the discharge phase of the pump element 9', each elongation of the pump element and shortening of the accumulator element 8' causes half the flow of the medium forced out of the pump element 9' to be accumulated or stored in the accumulator element 8'. The accumulator element 8' is also preferably designed so that its outer contour completely fills the pump element 9' when the latter is at its minimum volume.

Figure 7:
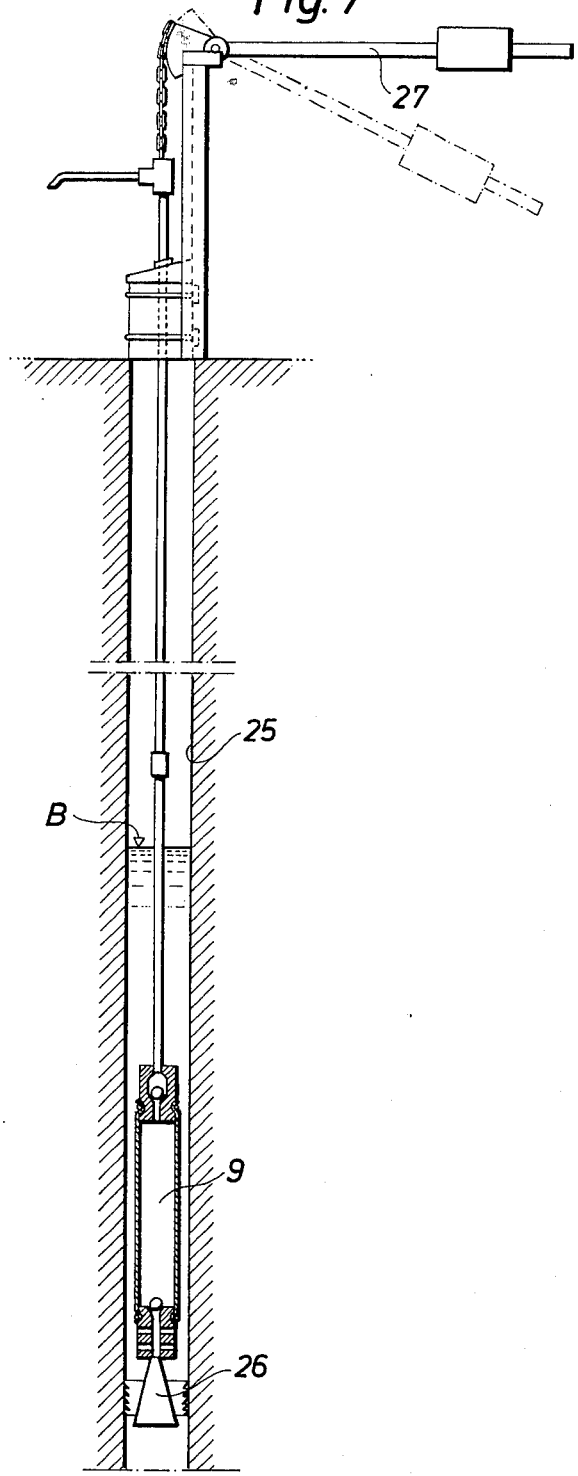
FIG. 7 shows a longitudinal section through yet another embodiment of the pump.

FIG. 7 shows another simpler embodiment of the invention. The pump here consists of the pump element 9, the suction end of which is releasably secured in a pipe 25 defining the well wall, by means of a retaining anchor 26 comprising a cone surrounded by a radially expandable body the inner peripheral surface of which is sloped to conform to the cone, the outer surface of which is provided with teeth. On pulling upward the body is forced to expand radially into contact with the wall of the pipe. The upper end of the pump element 9 is connected to the operating link 7 which also serves as discharge pipe and cooperates with a pumping handle or lever 27. The water level in the well is designated B. This alternative embodiment shows how the pump of the present invention can in practice be built and used in a constructionally simple manner.

The invention is of course not limited to the embodiments shown in the drawings but may be varied in many ways within the scope of the following claims.

Finally, it should be pointed out once again that the pump according to the invention can be considerably less expensive to manufacture than conventional pumps as well as being less sensitive to damage during transport and so on. Furthermore, there is no friction and all effort therefore goes to the pumping process itself and wear is eliminated. Furthermore, since there are no other constructional elements in the way, the two non-return valves may be in the form of large ball valves, preferably rubber-clad. This gives good flow, easy pumping and great reliability.

Since the operating rod in the invention also constitutes the discharge pipe, it can be made considerably smaller than for conventional pumps for the same pump area and may even comprise a coilable plastic tube since no compression need be transmitted as the operating link is in tension during each pumping stroke and may remain in tension during the return stroke when the resilience of the pump element 9, 9' actuates movement of the link. Since the flow of water achieved may be continuous both during the upward and downward movements of the operating link, the flow rate at any given instant will be only half that required for an intermittent pump having the same operating capacity and this also permits a further reduction in dimensions. The continuous flow easily possible with this invention also reduces the value of the repeated acceleration of the entire water column caused by a piston pump. The omission of a conventional drawing bar with its sleeves inside the discharge pipe also eliminates flow drag caused by all these reductions in flow area which would otherwise result in considerably decreased pump effect.

Since discharge pipe and operating rod in a conventional pump are responsible for a large part of the total cost, it can be easily understood that the preferred construction above is economically favourable with respect to these components as well.

Incorporating the discharge conduit in the drawing bar or link 7 also considerably simplifies the work in assembling and servicing the pump. This is particularly so if a coilable plastic tube is used.

I claim:

1. A pump comprising a variable volume operating chamber means, inlet means and discharge means for pumped medium, and valves operable to communicate said chamber means with said inlet means and said discharge means, said variable volume operating chamber means comprising a tubular pump element having a wall formed of an elastomeric material and at least two separate reinforcement systems embedded therein, each of said systems comprising at least one helically wound wire, each of said systems running in opposite directions relative to the axis of said tubular element, said tubular pump element having means for straining said wall for alternate axial extension and retraction, said extension and retraction causing an alternating diametral alteration of said wall effecting an overall change of the internal volume of the tubular pump element.

2. A pump according to claim 1, wherein said helical reinforcement wires have a pitch angle other than arccot $\sqrt{2}$ ($\sim 35.2°$).

3. A pump according to claim 2, wherein said helical reinforcement wires have a pitch angle greater than arccot $\sqrt{2}$ ($\sim 35.2°$), whereby axial tensile extension of the tubular element will effect an overall decrease of the internal volume thereof.

4. A pump according to claim 2, wherein said helical reinforcement wires have a pitch angle less than arccot $\sqrt{2}$ ($\sim 35.2°$), whereby axial tensile extension of the tubular element will effect an overall increase of the internal volume thereof.

5. A pump according to claim 3, comprising a pump housing with openings for inlet and discharge of a pumped medium; and an operating link cooperating with said tubular pump element and vertically movable in the pump housing, said valves comprising non-return valves arranged in the inlet and outlet to the tubular pump element, one end of said tubular pump element being connected to the operating link and the other end being secured in the pump housing so that when a tensile force is applied to the operating link the tubular pump element is extended and caused to decrease in volume resulting in ejection of pumped medium present in the pump element out through the outlet non-return valve and that upon the return movement of the operating link an increase in volume occurs resulting in flow of the pumped medium into the tubular pump element through the inlet non-return valve.

6. A pump according to claim 5, wherein said operating link is hollow and serves as the pump discharge conduit communicating with the outlet non-return valve from the tubular pump element.

7. A pump according to claim 6 including accumulator means communicating with said discharge means, said accumulator means comprising a tubular element of an elastomeric material having at least two reinforcing systems each of said systems comprising at least one helically wound wire, each of said systems extending in opposite directions with a pitch angle deviating from arccot $\sqrt{2}$ ($\sim 35.2°$), and wherein the pitch of said reinforcing system in one of said tubular pump and accumulator elements being greater than arccot $\sqrt{2}$ and the pitch in the other of said tubular element being less than arccot $\sqrt{2}$ so that upon simultaneous extension of these tubular elements the alteration in volume of the tubular accumulator element acquires the opposite sign to the simultaneous alteration in volume of the tubular pump element.

8. A pump according to claim 7, wherein the dimensions and resilience properties of the tubular accumulator element are adjusted with respect to those of the tubular pump element so that in use of the pump, each increase or decrease in the tractive force affecting both tubular pump element and tubular accumulator element will result in half the flow of medium forced out of the tubular pump element being stored in the tubular accumulator element to give optimum flow smoothing.

9. A pump according to claim 8, wherein the relaxed diameters of the pump and tubular accumulator elements are respectively equal and the length of the accumulator element is related to that of the pump element and their resilience properties are adjusted to give the optimum flow smoothing.

10. A pump according to claim 5, wherein the pump housing comprises an outer pipe provided at its lower end with means defining openings and at its upper end with an open-topped annular chamber and has a centrally arranged guide for the operating link; wherein the lower end of said operating link is connected to the upper end of the tubular pump element and a suction tube is connected to the lower end of the tubular pump element, said suction tube being provided with means defining inlet openings and being permanently connected to said outer pipe.

11. A pump according to claim 8, wherein the tubular accumulator element is disposed coaxially within the tubular pump element and is closed at one end, the other end of the tubular accumulator element communicating with the discharge means of the pump.

12. A pump according to claim 1 including a filler body disposed within said tubular pump element, said filler body consisting of an elastomeric material secured at its ends to said valve means and shaped in such a manner that its outer contour completely fills the tubular pump element when the volume of the tubular pump element is at a minimum.

13. A pump according to claim 1, including a releasable expander plug at the lower end of the tubular pump element for holding said tubular pump element securely within an external cylinder.

14. A pump according to claim 1 including accumulator means communicating with said discharge means, said accumulator means comprising a tubular element having a wall formed of an elastomeric material having at least two reinforcing systems embedded therein extending helically in opposite directions relative to the axis thereof and being arranged for alternate extension and contraction in response to the straining means on said tubular pump element, the alteration in volume of the tubular accumulator element being the opposite in sign to the simultaneous alteration in volume of the tubular pump element to smooth the pumped flow.

15. The pump according to claim 14 wherein the pitch angle of the reinforcement system in one of said tubular pump elements and tubular accumulator elements is greater than $\sqrt{2}$ ($\sim 35.2°$) and in the other one of said tubular pump elements and tubular accumulator elements is less than $\sqrt{2}$ ($\sim 35.2°$).

* * * * *